US006264447B1

(12) United States Patent
Woodcock

(10) Patent No.: US 6,264,447 B1
(45) Date of Patent: Jul. 24, 2001

(54) AIR-COOLED SHAFT SEAL

(75) Inventor: Glenn Woodcock, Conover, NC (US)

(73) Assignee: Dynisco, Sharon, MA (US)

( * ) Notice: Subject to any disclaimer, the term of this patent is extended or adjusted under 35 U.S.C. 154(b) by 0 days.

(21) Appl. No.: 09/685,438

(22) Filed: Oct. 11, 2000

Related U.S. Application Data

(62) Division of application No. 09/303,702, filed on May 3, 1999.

(51) Int. Cl.[7] ..... F04C 29/04

(52) U.S. Cl. ..... 418/102; 418/101; 418/104; 277/429; 277/430; 277/563; 277/2; 184/61

(58) Field of Search ..... 418/102, 101, 418/104; 277/429, 430, 563, 2; 184/61

(56) References Cited

U.S. PATENT DOCUMENTS

| | | | | |
|---|---|---|---|---|
| 244,013 | * | 7/1881 | Whitney | 184/61 |
| 863,153 | * | 8/1907 | Coffman | 184/61 |
| 1,604,078 | * | 10/1926 | Schneider | 184/61 |
| 2,038,299 | * | 4/1936 | Kohlhagen | 277/430 |
| 2,487,177 | * | 11/1949 | Pollock | 277/429 |
| 3,250,260 | * | 5/1966 | Heydrich | 418/101 |
| 3,331,101 | * | 7/1967 | Thomas, Jr. | 277/430 |
| 3,368,799 | * | 2/1968 | Sluijters | 418/102 |
| 3,940,150 | * | 2/1976 | Martin et al. | 277/22 |
| 3,975,026 | | 8/1976 | Boyle et al. . | |
| 3,976,405 | | 8/1976 | Geiger et al. . | |
| 4,010,960 | * | 3/1977 | Martin | 277/22 |
| 4,090,820 | | 5/1978 | Teruyama . | |
| 4,114,899 | * | 9/1978 | Kulzer et al. | 277/22 |
| 4,160,630 | | 7/1979 | Wynn . | |
| 4,222,705 | | 9/1980 | Smith . | |
| 4,240,000 | | 12/1980 | Harano et al. . | |
| 4,265,602 | | 5/1981 | Teruyama . | |
| 4,293,291 | | 10/1981 | Link . | |
| 4,336,213 | | 6/1982 | Fox . | |
| 4,392,798 | | 7/1983 | Bowden . | |
| 4,395,207 | | 7/1983 | Manttari et al. . | |
| 4,420,291 | | 12/1983 | Winstead . | |
| 4,470,776 | | 9/1984 | Kostek et al. . | |
| 4,471,963 | * | 9/1984 | Aihart | 277/22 |
| 4,515,512 | | 5/1985 | Hertell et al. . | |
| 4,515,513 | * | 5/1985 | Hayase et al. | 418/101 |
| 4,573,889 | | 3/1986 | Lane . | |

(List continued on next page.)

FOREIGN PATENT DOCUMENTS

| | | | | |
|---|---|---|---|---|
| 580824-A1 | * | 8/1959 | (DE) | 418/101 |
| 0024024-A1 | * | 2/1981 | (DE) | 418/102 |
| 4111218-A1 | * | 10/1992 | (DE) | 418/102 |
| 1293881-A1 | * | 4/1962 | (FR) | 418/101 |
| 322778-A1 | * | 12/1929 | (GB) | 418/102 |
| 335735-A1 | * | 10/1930 | (GB) | 418/101 |

OTHER PUBLICATIONS

Naffah et al., "Gear Pump Bearing Design for Improved Plastics Processing," Paper #469, Maag Pump Systems Textron AG (Zurich, Switzerland).

*Primary Examiner*—Thomas Denion
*Assistant Examiner*—Theresa Trieu
(74) *Attorney, Agent, or Firm*—Jenkins & Wilson, P.A.

(57) ABSTRACT

An air-cooled shaft seal comprises an annular body having an inner surface and an outer surface. One or more helical channels are formed on the inner surface. A plurality of external surfaces such as radial fins are disposed in axially spaced relationship on the outer surface, and extend radially in a direction away from a longitudinal axis of the annular body. The external surfaces present a substantially increased surface area through which heat energy is transferred from polymeric material contained in the seal to the atmosphere. The seal may be installed on one or shafts of a gear pump for transporting a viscous material under pressure.

26 Claims, 10 Drawing Sheets

U.S. PATENT DOCUMENTS

| | | |
|---|---|---|
| 4,575,100 | 3/1986 | Hay, II et al. . |
| 4,629,405 | 12/1986 | Hidasi et al. . |
| 4,642,040 | 2/1987 | Fox . |
| 4,645,418 | 2/1987 | Siegel . |
| 4,648,816 | 3/1987 | Sauter . |
| 4,682,938 | 7/1987 | Riordan . |
| 4,699,575 | 10/1987 | Geisel et al. . |
| 4,716,494 | 12/1987 | Bright et al. . |
| 4,725,211 | 2/1988 | Gray . |
| 4,737,087 | 4/1988 | Hertell . |
| 4,813,863 | 3/1989 | Hahn et al. . |
| 4,859,161 | 8/1989 | Teruyama et al. . |
| 4,927,343 | 5/1990 | Lonsberry . |
| 5,051,071 | 9/1991 | Haentjens . |
| 5,119,886 | 6/1992 | Fletcher et al. . |
| 5,145,341 | 9/1992 | Drane . |
| 5,220,978 | 6/1993 | McMaster . |
| 5,224,838 | 7/1993 | Baumgarten . |
| 5,253,988 | 10/1993 | Hunziker et al. . |
| 5,322,421 | 6/1994 | Hansen . |
| 5,324,183 | 6/1994 | Capelle . |
| 5,394,040 | 2/1995 | Khanh . |
| 5,417,556 | 5/1995 | Waddleton . |
| 5,462,240 | 10/1995 | Stehr et al. . |
| 5,468,131 | 11/1995 | Blume et al. . |
| 5,494,425 | 2/1996 | Stehr . |
| 5,547,356 | 8/1996 | Stehr et al. . |
| 5,549,462 | 8/1996 | Mischler et al. . |
| 5,569,429 | 10/1996 | Luker . |
| 5,629,573 | 5/1997 | Ponnappan et al. . |
| 5,641,281 | 6/1997 | Russell et al. . |
| 5,702,234 | 12/1997 | Pieters . |
| 5,772,417 | 6/1998 | Stehr et al. . |
| 5,791,125 | 8/1998 | Kallner . |
| 5,913,608 | 6/1999 | Blume . |
| 6,179,594 | 1/2001 | Woodcock ..... 418/102 |

* cited by examiner

AIR-COOLED SHAFT SEAL

CROSS-REFERENCE TO RELATED APPLICATION

This application is a Divisional of co-pending U.S. patent application Ser. No. 09/303,702 filed May 3, 1999, the contents of which are incorporated herein by reference.

TECHNICAL FIELD

The present invention relates generally to apparatus and methods for sealing the rotating shaft of a fluid-containing housing, such as the drive shaft of a fluid-conveying pump. More particularly, the present invention relates to apparatus and methods for cooling a seal that utilizes the fluid conveyed by a pump to improve the performance of the seal.

BACKGROUND ART

Various types of pumps are utilized in fluid transporting systems in order to develop and maintain a desired amount of flow energy in the fluid. Many of these pumps require for their operation at least one rotatable shaft to drive a mechanical energy-transferring device such as a piston, impeller, or gear. Typically, the rotational power or torque transmitted to the shaft is generated in a motor disposed in remote relation to the pump housing. Thus, a portion of the shaft necessarily extends outside the housing through, for example, a bore in a wall of the housing, for direct or indirect linkage to the motor. The shaft is supported or mounted in the housing, but must be free to rotate at the interface of the housing and shaft in accordance with the operation of the pump.

A clearance of operationally-significant magnitude therefore exists between the bore of the housing wall and the shaft, even in a case where a bushing or like element is employed at the shaft housing or pump/atmosphere interface. It is recognized that over the range of operating pressures of the pump, this clearance presents a potential leakage point. Depending on the direction of the pressure gradient between the interior of the pump housing and the atmosphere, the leakage point may be characterized by fluid leaking out of the pump or air infiltrating into the pump. The leakage may contribute to a variety of undesirable conditions, including reduced pump efficiency, reduced economic life of the pump and related components, increased maintenance costs, and contamination or non-uniformity of the fluid being pumped. Accordingly, it is well understood that the pump must include some means for sealing the shaft at the interface.

The approach taken in the design of the shaft seal is especially critical in the context of gear pumps, which are utilized in a number of well-known applications to meter and discharge various types of fluids. A gear pump may generally be described as being a rotary, positive displacement pump. In its most basic design, the gear pump includes a pair of intermeshing spur, single-helical or double-helical (i.e., herringbone) gears disposed in a housing having narrow internal dimensional tolerances. One gear serves as the driving gear and is rotatable with a drive shaft, i.e., the shaft powered by a motor. The other gear serves as the driven gear and is rotatable on an idler shaft. The shafts are mounted in journal bearings on each side of gears. In operation, the gears create a pressure differential between a suction side and a discharge side of the gear pump housing. The working fluid is drawn into the housing at the suction side, is carried by the teeth of each gear in spaces defined by the teeth and one or more internal surfaces of the housing, and is squeezed out on the discharge side. This design results in a relatively constant rate of fluid flow with a minimum of drifting or slippage. The flow rate is dependent on gear rotational speed, but is largely unaffected by viscosity variations and pressure differential variations across the gear pump.

The performance characteristics of the gear pump make it especially useful in the processing of high-shear polymers such as rubber, PVC, and EDPM, where pressure, volume and uniformity of the flowing material must be controlled. For example, the gear pump may be used to transport synthesis polymeric material from a reaction vessel. The gear pump may also be used in connection with an extruder. A typical extruder includes an elongate barrel containing a rotating auger or screw. A hopper feeds pellets or granules of the polymeric material to the barrel, where the material is heated and melted as it is forced along the length of the barrel by the screw. In such an application, the gear pump is installed between the extruder and an extrusion die to pressurize and meter the polymer melt flow, and to dampen any pressure fluctuations or surges caused by the rotating screw of the extruder. Because the gear pump moves fluid more efficiently than the extruder and reduces the load on the extruder, the gear pump itself can be used to develop the high pressure needed in the fluid line. This enables the discharge pressure of the extruder to be separately adjusted to a reduced level in better accord with the extruder's own optimal operating point. Finally, the gear pump may be installed in line with two or more extruders as part of a compounding or mixing process to obtain similar advantages.

In view of the foregoing, it is readily apparent that the gear pump may produce not only a high pressure differential between the inlet and outlet fluid conduits communicating with the gear pump, but also a high pressure differential between the interior of the gear pump and the atmosphere. Thus, the problem of leakage in gear pumps may be potentially significant.

The leakage problem is further exacerbated when the gear pump is used to process viscous fluids. For example, in polymeric material processing the bearings selected for the gear pump are typically hydrodynamic and self-lubricating. That is, instead of using a separate lubrication method such as a forced oil circulation system, the gear pump and bearings are designed with flow paths for diverting a portion of the incoming polymer melt flow and circulating that portion between the bearings and shafts prior to discharge from the gear pump. The radial clearance provided in the bearing permits a wedgeshaped polymeric film to develop between the journal and the bearing as the shaft rotates. As a result, a hydrodynamic pressure is generated in the film that is sufficient to float the journal portions of the shafts and support the loads applied to them. And since the journal portion of the rotating shaft does work on the polymeric film and induces shear stresses therein, the frictional heat energy produced raises the film temperature. Consequently, the heated and pressurized polymer melt flowing in the vicinity of the shaft/housing interface has a high tendency to leak out from the pump.

Previous sealing solutions have not adequately controlled the leakage problem observed in gear pumps. In one application typical of the prior art, the sealing means took the form of a packing seal. A packing seal is constructed of one or more layers, windings or gaskets constructed of packing material such as graphite-impregnated cotton. The packing material is compressed within a packer or stuffing box. The stuffing box is usually disposed adjacent to the main pump housing. The main shaft of the gear pump extends outside the housing and through the stuffing box, such that the compressed packing material is squeezed against the shaft.

Apart from its general ineffectiveness in environments marked by high pressure differentials, the packing seal suffers from several other problems The compressed packing material, although treated with graphite, is nonetheless abrasive enough to produce substantial frictional contact with the shaft and thereby accelerate wear and deterioration of the shaft as well as the packing material itself, inviting frequent replacement of both. Additionally, the excessive frictional contact engendered by the packing material causes the pump to work harder, which lowers output and efficiency.

An attempt to improve the utility of the packing seal in the context of polymer processing is disclosed in U.S. Pat. No. 4,515,512 to Hertell et al. The gear pump disclosed in the Hertell patent includes a stuffing box attached to an end wall of the main pump housing. The stuffing box is thus adjacent to and outside of the housing. The drive shaft of the gear pump extends through a bore in the end wall of the housing, through the stuffing box, and to the outside. There is no seal directly located in the clearance or gap created between the shaft and the bore of the gear pump housing end wall Accordingly, the fluid being pumped has a relatively unrestricted path by which to flow through the gap and into the stuffing box.

The Hertell patent provides two sets of gaskets, which are packed within the stuffing box in annular disposition around the shaft and the inner contour of the stuffing box. An annular cavity in the stuffing box separates the two gasket sets. A plurality of springs are circumferentially spaced in the annular cavity between the between the two gasket sets. The end of the stuffing box opposite the main pump housing is capped with a threaded flange annularly disposed around the shaft. Adjustment of the flange maintains axial compression of the gaskets in the direction of the gear housing, thereby maintaining frictional contact between the gaskets and the shaft. Within the annular cavity, the springs provide a biasing force to maintain a volume in the cavity between the two gaskets sets, as well as assist in compressing the gaskets. An inlet an outlet tube are placed in communication with the cavity and lead to a remote solvent reservoir, which stores a polymer solvent such as glycol. This arrangement serves to circulate and cool the solvent in the annular cavity.

In operation, some of the pressurized polymeric material in the housing of the gear pump in the Hertell patent tends to leak through the gap in the end wall in the direction of the stuffing box. However, the pump is configured with a bypass line such that the pressure in the gap is essentially equalized to the pressure on the suction side of the pump. This creates a pressure gradient in the direction of the stuffing box to the gear pump housing, so that polymer solvent tends to travel from the annular cavity of the stuffing box toward the housing. In this manner, it is intended that the solvent meet the leaking polymer and dissolve it.

It should be apparent from the foregoing that the concept disclosed in the Hertell patent is primarily directed at protecting the packing seal from leaking polymeric material by incorporating a complex and burdensome polymer solvent circulation system into the gear pump. That is, this concept does not focus on preventing leakage of fluid from the pump housing. In practice, the concept may improve the life of the packing material of the seal, but does not resolve the afore-described problems associated with the packing seal itself. Moreover, the solvent circulation system introduces additional problems. For instance, the Hertell patent acknowledges that, due to the pressure gradient, some of the solvent supplied may reach the interior of the gear pump and be discharged with the polymer melt flow. Such a result is clearly undesirable where even moderate quality control of the polymer product is specified. Also, the range of use of the Hertell system is limited, as many high-pressure/high-viscosity/high-temperature applications could be expected to overcome the capacity of the solvent system to prevent polymeric material from flooding the stuffing box, degrading or overwhelming the packing material, and leaking to the atmosphere. Another approach to sealing a gear pump operating in a highly viscous environment is disclosed in U.S. Pat. No. 4,699,575 to Geisel et al., which avoid use of a stuffing box. In the Geisel patent, a plurality of annular bushings constructed of a resilient plastic are press-fitted onto the drive and idler shafts of an adhesive gear pump, at locations between each gear and each journal bearing of the gear pump. The gear pump is configured with means for circulating an incompressible lubricant grease at high pressure throughout the gear pump, and through gaps located in proximity to the plastic bushings. The circulation means requires, among other things, several grease fittings for charging the circulation system, several internal passages within the gear pump, and high-pressure outlet relief valves leading to the atmosphere. According to the Geisel patent, the adhesive flowing through the gear pump is prevented from creeping past the bushings because the gaps are kept continuously filled with the incompressible grease. This approach presents many of the same disadvantages as described in regard to the Hartell patent, in that it specifies a system for circulating an additional material through the gear pump and accordingly introduces unnecessary complexities.

The first valid approach toward solving, rather than mitigating, the leakage problem in polymer processing applications is believed to be disclosed in U.S. Pat. No. 4,336,213 to Fox. In the gear pump disclosed therein, a seal is provided directly at the housing/shaft interface, and uses the polymeric material itself to complete the seal. The seal includes a cylindrical sleeve that is inserted onto the portion of the shaft extending beyond the pump housing. The seal member has a flange at the end of the sleeve opposite the pump housing. A plurality of holes are circumferentially disposed around an annular shoulder portion of the flange, through which bolts may be inserted to tightly secure the seal to the housing in annular disposition with the shaft. When inserted onto the shaft, the cylindrical inner surface of the sleeve abuts the outer surface of the shaft. Accordingly, the inner surface of the sleeve and the outer surface of the shaft together define a clearance or gap which becomes the potential leakage point for the gear pump.

The seal in the Fox patent is characterized in part by the fact that a shallow helical channel is formed on the inner surface of the sleeve. The helical channel extends substantially along the entire length of the inner surface The orientation or "hand" of the helical path taken by the channel is opposite to that of the shaft rotation. Thus, during operation of the gear pump, polymeric material entering the clearance between the sleeve and shaft tends to travel in the helical channel. However, given the opposite orientation of the helix, the leaking material is effectively pumped back toward the interior of the pump housing and thus is prevented from leaking to the outside. In essence, the configuration of the sleeve, flanged and bolted to the housing, provides a mechanical seal while the polymeric material opposed by the helical channel provides a viscous, relatively static seal. Furthermore, the existence of the polymeric material in the clearance significantly reduces friction therein. Accordingly, this design has been highly effective as a seal for gear pumps operating over a considerable range of pressures, temperatures and viscosities.

In U.S. Pat. No. 4,471,963 to Airhart, an attempt was made to improve upon the design disclosed in the Fox patent. As in the Fox patent, the seal provided in the Airhart patent includes a cylindrical sleeve that is flanged and bolted to the housing of the gear pump. Two helical channels are formed on the inner surface of the sleeve and are axially separated by a relatively deep and wide annular cavity. The first helical channel begins at a point proximate to the pump housing and terminates in fluid communication with the annular cavity. On the opposite side of the annular cavity farthest from the housing, the second helical channel communicates with the annular cavity and terminates at a point proximate to the outer end of the sleeve. The orientation of the first helical channel is the same as that of the rotating shaft, and hence polymeric material leaking from the gear pump had a high tendency to flow through the first helical channel and accumulate in the annular cavity. On the other hand, the second helical channel has an opposite orientation, such that it impedes outwardly axial flow of polymeric material beyond the annular cavity.

The seal in the Airhart patent is characterized in that means are provided for actively cooling the polymeric material accumulated in the annular cavity so as to create a polymeric plug. Two bores are drilled at diametrically opposite sides of the flange and communicate with an annular passageway formed within the solid cross-sectional portion of the cylindrical sleeve of the seal. The bores are connected via tubing to a circulation system. During operation of the pump, water or other coolant is circulated through the bores and the annular passageway to carry heat away from the polymeric material present in the seal, thereby solidifying the polymeric material and forming the plug.

The approach for improving the helically-channeled seal disclosed in Fox by active cooling is at first glance attractive. However, as in the case of the Hertell and Geisel patents, the seal in the Airhart patent requires external equipment and conduits to circulate an additional fluid through the pump. This adds to the cost and complexity of the gear pump, and introduces additional areas of maintenance.

The present invention is therefore provided to solve these and other problems associated with the prevention of leakage of rotating shafts in general, and specifically with the prevention of leakage at the shaft/housing interface of gear pumps operating in polymer processing applications.

DISCLOSURE OF THE INVENTION

In accordance with the present invention, an improved sealing apparatus is provided with structure for passively cooling the seal. In one embodiment, an air-cooled shaft seal comprises an annular body having an inner surface and an outer surface. One or more helical channels are formed on the inner surface. A plurality of external surfaces such as radial fins are disposed in axially spaced relationship on the outer surface, and extend radially in a direction away from a longitudinal axis of the annular body. The external surfaces present a substantially increased surface area through which heat energy is transferred from polymeric material contained in the seal to the atmosphere. In systems where viscous material such as polymer melt or adhesive is being processed, the structure of the present invention permits a substantial amount of heat energy dissipation, and is effective to form a relatively static and frictionless seal or plug in the helical channel itself, without the need for an annular cavity or external active heat transfer equipment.

In another embodiment, a gear pump for transporting a viscous material under pressure comprises a housing having first and second sides, wherein each side has a hole. A shaft is disposed in the housing and extends through the first and second holes of the housing. The shaft has a first outer section disposed outside the housing beyond the first hole and a second outer section disposed outside the housing beyond the second hole. A sealing member is annularly disposed around the shaft and defines an annular space between an inner surface of the sealing member and the outer surface of the shaft. The sealing member has a first portion disposed in the first hole and a second portion disposed outside the housing. In addition, the sealing member includes a plurality of external surfaces disposed in axially spaced relationship on the second portion. The shaft upon which the sealing member is installed may be the drive shaft of the gear pump.

Therefore, it is an object of the present invention to provide an improved seal for a rotating shaft.

It is another object of the present invention to provide a shaft seal for a pump which is adapted to cool material leaking therein without the use of active cooling means.

Some of the objects of the invention having been stated hereinabove, other objects will become evident as the description proceeds, when taken in connection with the accompanying drawings as best described hereinbelow.

DETAILED DESCRIPTION OF THE PREFERRED EMBODIMENT

The following embodiments of the present invention are described with particular application to the field of polymer processing. It will be readily understood, however, that the broad teachings of the present invention have utility in any application wherein passive cooling of a shaft seal improves sealing performance.

Figure 1:
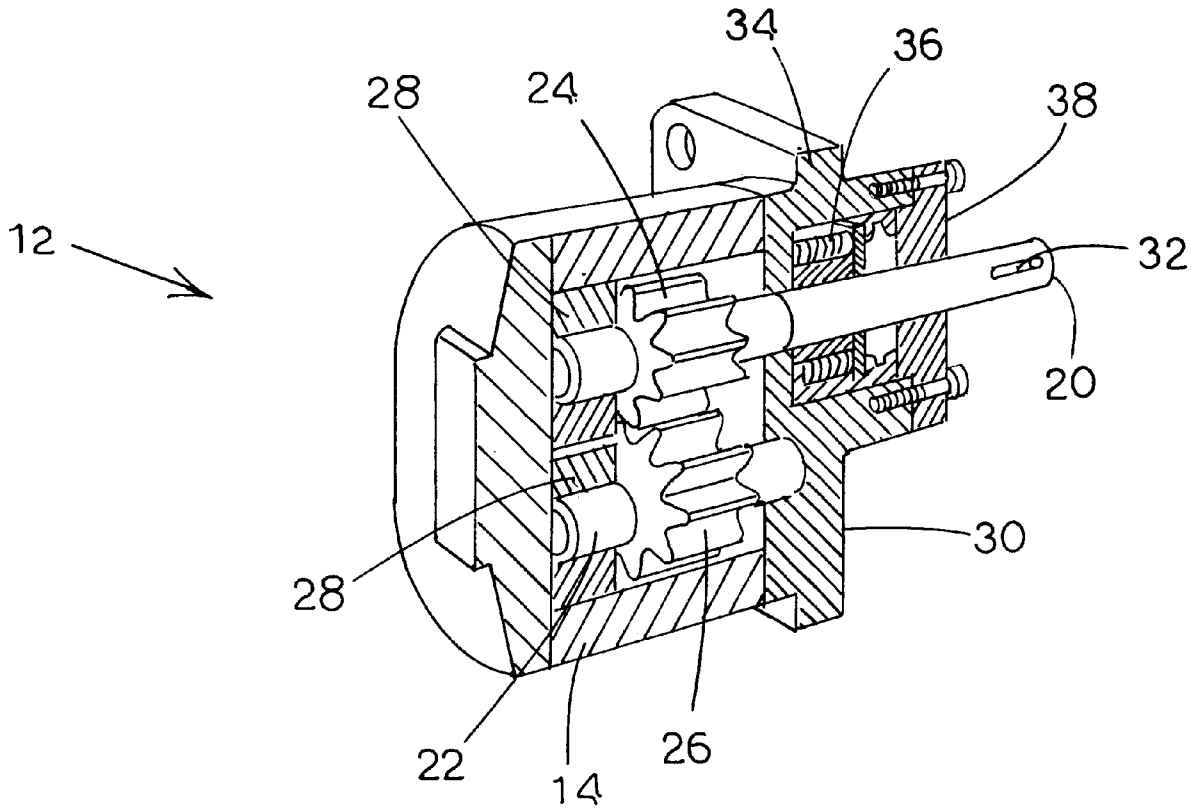
(PRIOR ART) FIG. 1
FIG. 1 is a perspective cut-away view of a conventional gear pump using a packing seal.
Figure 2:
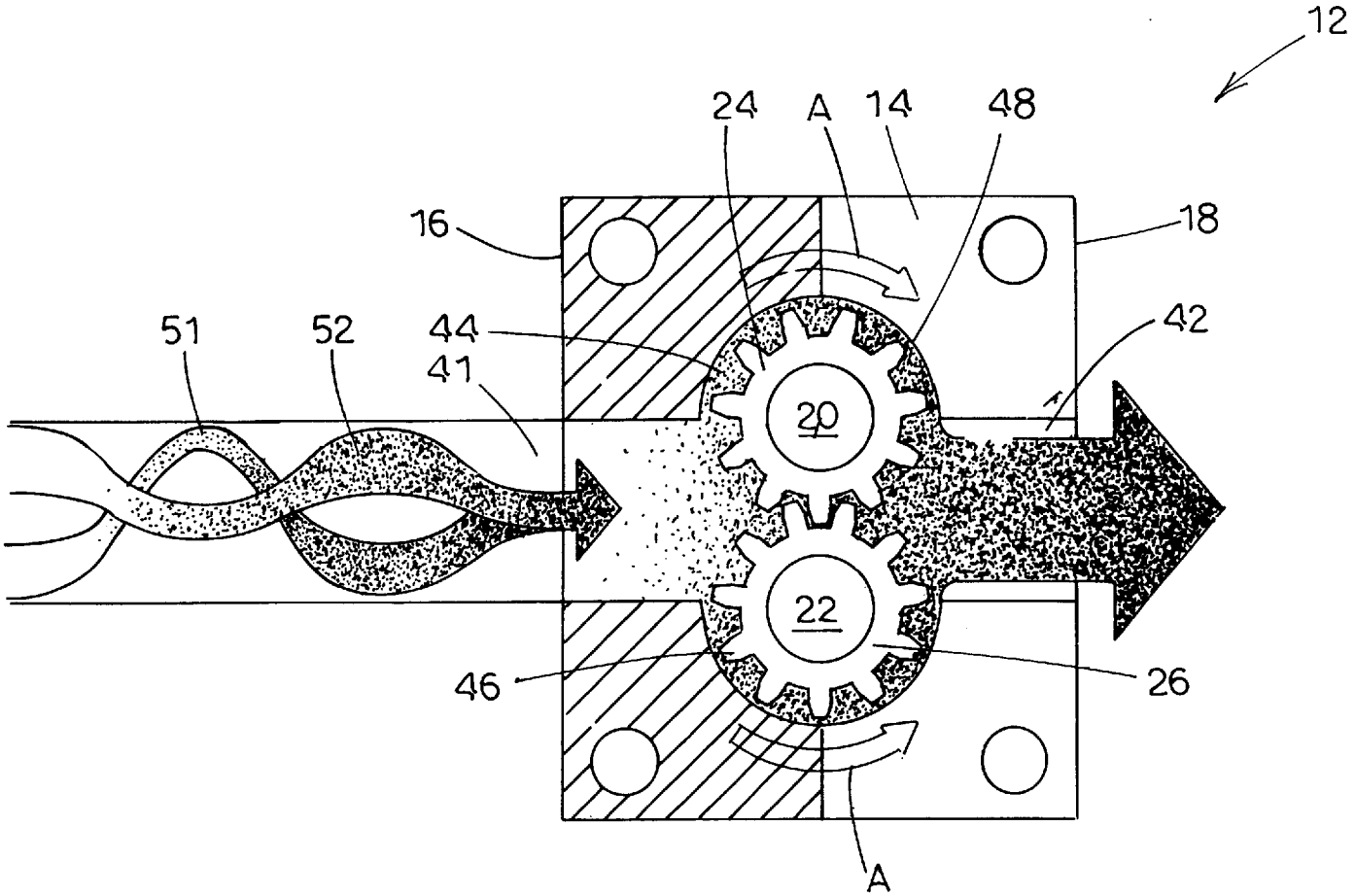
(PRIOR ART) FIG. 2
FIG. 2 is a vertical cross-sectional view of a typical gear pump showing the fluid moving operation of the gear pump.

FIGS. 1 and 2 illustrate the main components of a conventional gear pump generally designated 12. Gear pump 12 has a main housing 14 with a suction side 16 and a discharge side 18. A drive shaft 20 and an idler shaft 22 are mounted within main housing 14 in parallel relation. Drive shaft 20 includes a driving gear 24 and idler shaft 22 includes a driven gear 26 meshing with driving gear 24. Each shaft 20, 22 is rotatably mounted in one or more journal bearings 28. Bearings 28 are typically hydrodynamic and self-lubricating. Drive shaft 20 extends through a sealing side 30 of main housing 14 and includes a keyway 32 or similar means for coupling drive shaft 20 with transmission and prime moving means (not shown) such as a gear reduction box and motor, respectively. A packing or stuffing box 34 is formed on or attached to sealing side 30 of main housing 14. Stuffing box 34 contains packing material 36 compressed against drive shaft 20, as described above, and is closed with a flange 38 bolted thereto.

As best shown in FIG. 2, main housing 14 has an inlet port 41 on suction side 16 and an outlet port 42 on discharge side 18. In operation, the rotating shafts 20, 22 cause gears 24, 26 to mesh in the direction shown by the arrows A. This movement creates a pressure differential across gear pump 12. Accordingly, material is drawn into main housing 14 on suction side 16 and is carried in spaces 44 defined by teeth 46 and internal chambers 48 of housing 14. The material is then discharged at high pressure on discharge side 18. In most cases, gear pump 12 effectively dampens the undesirable conditions occasioned by screwbeat 51 and surge 52 from an upstream extruder and provides a uniform, pressurized flow of material for further processing.

Figure 3:
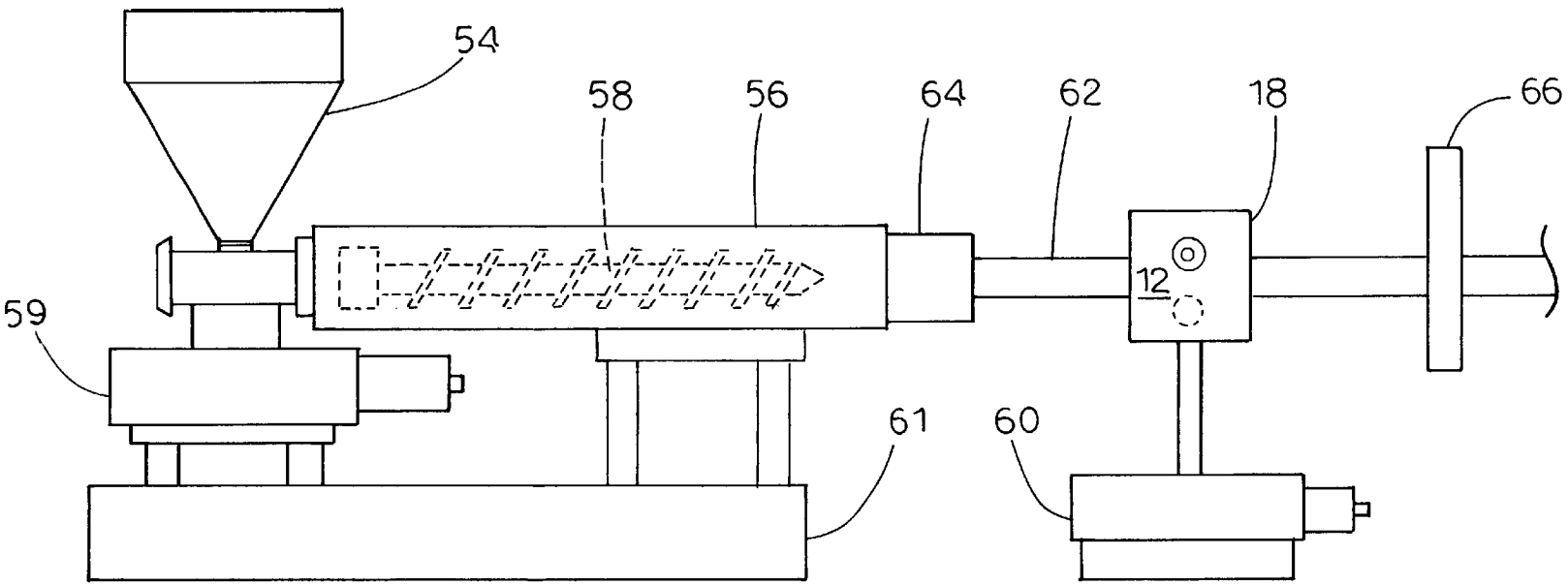
(PRIOR ART) FIG. 3
FIG. 3 is a side elevation view of a portion of a polymer processing system wherein a gear pump is utilized.

FIG. 3 illustrates gear pump 12 installed in a typical polymer processing application. A hopper 54 delivers pelletized or granulated polymer feedstock to an extruder 56. Extruder 56 includes an auger or screw 58 and means for heating and melting the polymer feedstock. Auger 58 and gear pump 12 are powered by motors 59, 60. Extruder 56 and motor 59 are mounted on appropriate support means 61. Melted polymeric extrudate exits extruder 56 and flows toward gear pump 12 along a process line or conduit 62. A screen or filter means 64 may be interposed between extruder 56 and gear pump 12. From discharge side 18 of gear pump 12, the pressurized and heated polymeric extrudate flows through a die 66. Depending on the particular application, die 66 is adapted to extrude a sheet tube or other profile. Other components such as cooling units and slitters (not shown) may be installed downstream of die 66 as needed.

Figure 4:
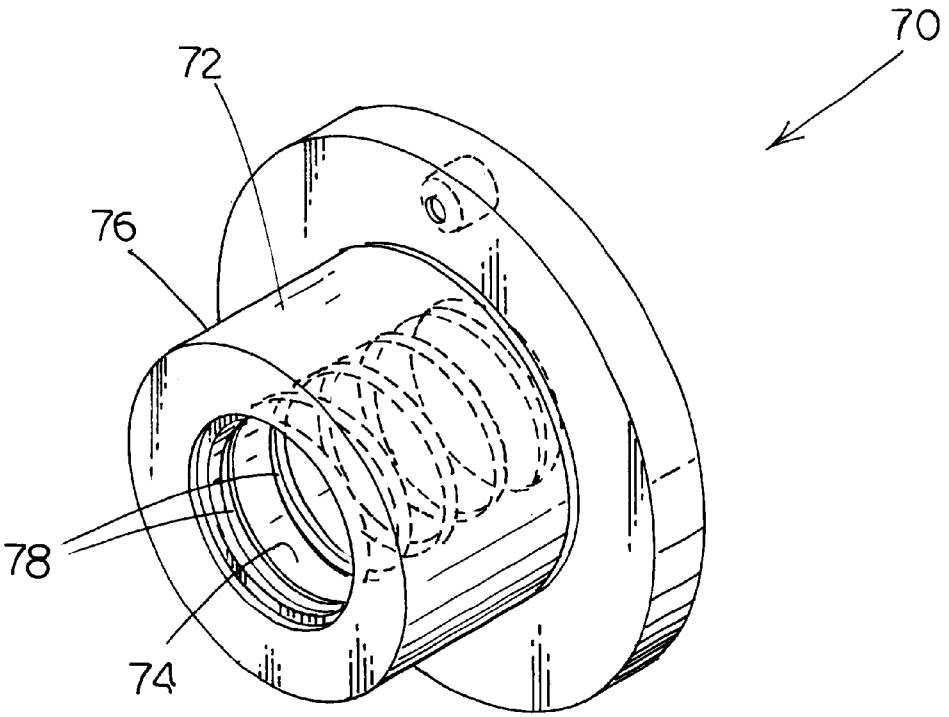
(PRIOR ART) FIG. 4
FIG. 4 is a perspective view of a gear pump seal of the prior art that includes a helical channel.
Figure 5:
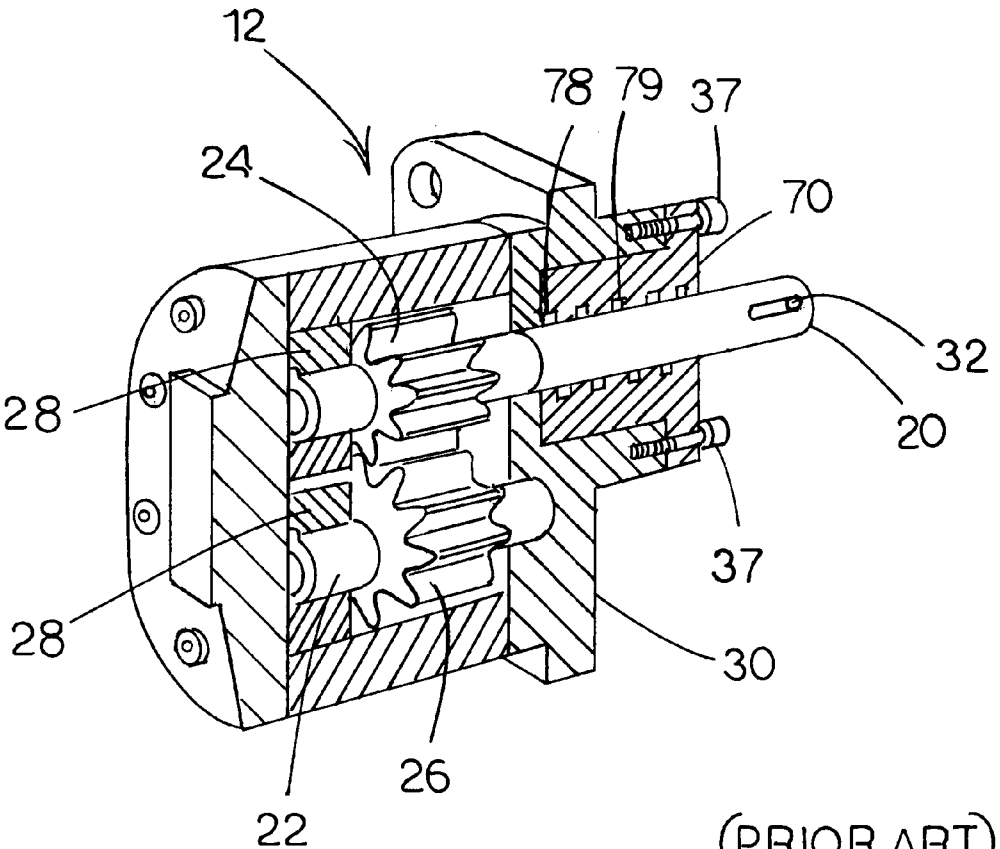
(PRIOR ART) FIG. 5
FIG. 5 is a perspective cut-away view of a gear pump of the prior art that includes the seal of FIG. 4.

FIGS. 4 and 5 illustrate a shaft sealing member generally designated 70 without the passive cooling means of the present invention. Sealing member 70 includes a cylindrical body 72 with a central cylindrical bore 74 and outer surface 76. A helical channel 78 is formed in cylindrical bore 74. Sealing member 70 is mounted to drive shaft 20 of gear pump 12 with helical channel 78 turning in a direction opposite to that of rotation of drive shaft 20. Helical channel 78 and cylindrical body 72 together define a continuous clearance space 79 wrapped around drive shaft 20 within sealing member 70. When gear pump 12 is placed in operation, polymeric material leaking axially into sealing member 70 from main housing 14 of gear pump 12 tends to enter helical channel 78, wherein drag forces of oppositely oriented helical channel 78 oppose further leakage. In many applications, sealing member 70 does not provide a satisfactory seal because outer surface 76 of cylindrical body 72 and outer surfaces of sealing side 30 of gear pump 12 cannot sufficiently cool the leaking polymeric material residing therein.

FIGS. 6–11 illustrate practical applications of the present invention for improving the sealing effect of a shaft seal, which retain the benefits accruing from a helical-type channel but avoid the use of external circulation equipment or other active cooling means. Referring to FIGS. 6A and 6B, a sealing member generally designated 80 includes a body or sleeve generally designated 82 and has an inner surface 84 defining a cylindrical bore 86. Sleeve 82 is preferably cylindrical as shown, but other cross-sectional shapes may be provided if desired. A helical groove or channel 88 is formed on inner surface 84 along an axial length of cylindrical bore 86. Helical channel 88 begins at a point on an inner end 91 of sleeve 82 communicating with the interior of a gear pump. On an outer end 92 of sleeve 82—that is, the end of sleeve 82 open to the atmosphere outside the gear pump—a plurality of axially spaced external surfaces are included, preferably in the form of cooling fins 94 that extend radially from an outer surface 96 of sleeve 82. Fins 94 may be formed by reducing the diameter of a first section 98 of sleeve 82 to define a flange 101 of larger diameter on a second section generally designated 103 of sleeve 82, then cutting into flange 101 at axially spaced intervals. Alternatively, flange 101 and fins 94 are provided as separate elements and secured onto sleeve 82 such as by press-fitting. A plurality of mounting bores 104 are drilled through fins 94 and flange 101 at circumferential intervals around cylindrical bore 86, through which bolts may extend to secure sealing member 80 to a gear pump.

Sealing member 80 is preferably constructed of stainless steel. If press-fitted onto sleeve 82, the material selected for fins 94 may be different than that of sleeve 82 in order to tailor the heat transfer properties of sealing member 80 to specific needs.

The dimensions of sealing member 80 will depend upon the size of the gear pump and shaft used, as well as the internal temperatures expected to be developed in the proximity of the sealing area. The following dimensions are given as an example. Sleeve 82 has an overall axial length of 1.65" of which first section 98 has an axial length of 0.78". First section 98 has an outside diameter of 2.0" and second section 103 with fins 94 has an outside diameter of 3.0", such that fins 94 have a radial height of 0.5". Inner surface 84 of sleeve 82 forming cylindrical bore 86 has an inside diameter of 1.02". Outer and inner surfaces 96, 84 of sleeve 82 together define an annular thickness 106 of approximately 0.5". As best seen in FIG. 10A, helical channel 88 has a depth of 0.01" from inner surface 84 of sleeve 82 into annular thickness 106 and has an axial width of 0.125". The helix angle of helical channel 88 is such that helical channel 88 makes two turns per inch of axial length of sleeve 82; however, the helix angle could be varied along the axial length of sleeve 82. The width of lands 108 between each section of helical channel 88 is 0.125". Each fin 94 has a thickness or axial width of 0.09". Fins 94 are spaced apart at intervals of 0.06".

The number of fins 94 formed or disposed on sleeve 82 are shown to be four, but the precise number may be varied. More importantly, the number and dimensions of fins 94 are specified so as to provide a substantial increase in the surface area available for transfer of heat energy from polymeric material present in helical channel 88 to the atmosphere. The increase in the amount of heat energy removed by the mechanisms of conduction and convection is obtained without the use of a coolant circulation system. Moreover, fins 94 constitute a passive heat transfer device that is much more efficient and simple than an active cooling device.

Figure 6B:
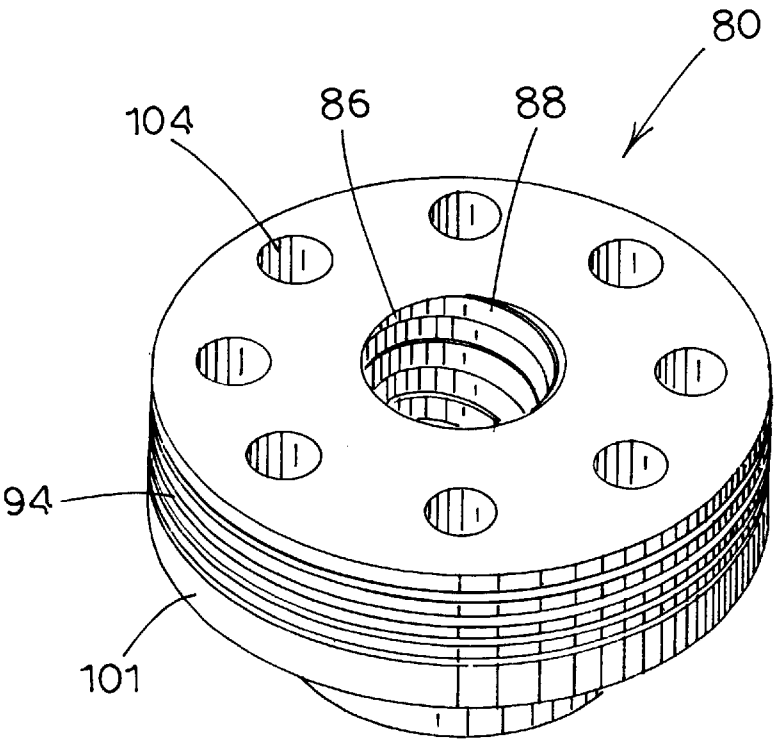
FIG. 6B is a perspective view of the sealing member of FIG. 6A.
Figure 6A:
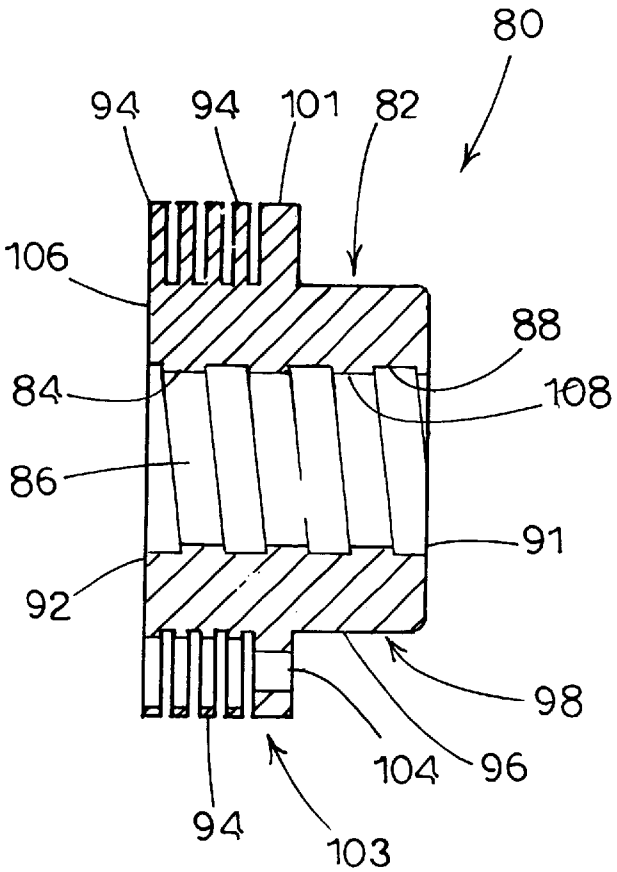
FIG. 6A is a side cross-sectional view of a sealing member according to the present invention.
Figure 7B:
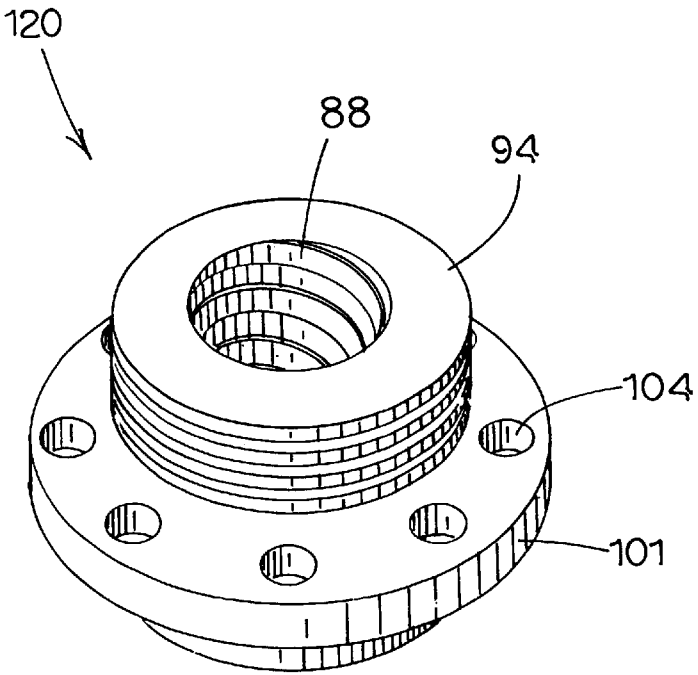
FIG. 7B is a perspective view of the sealing member of FIG. 7A.
Figure 7A:
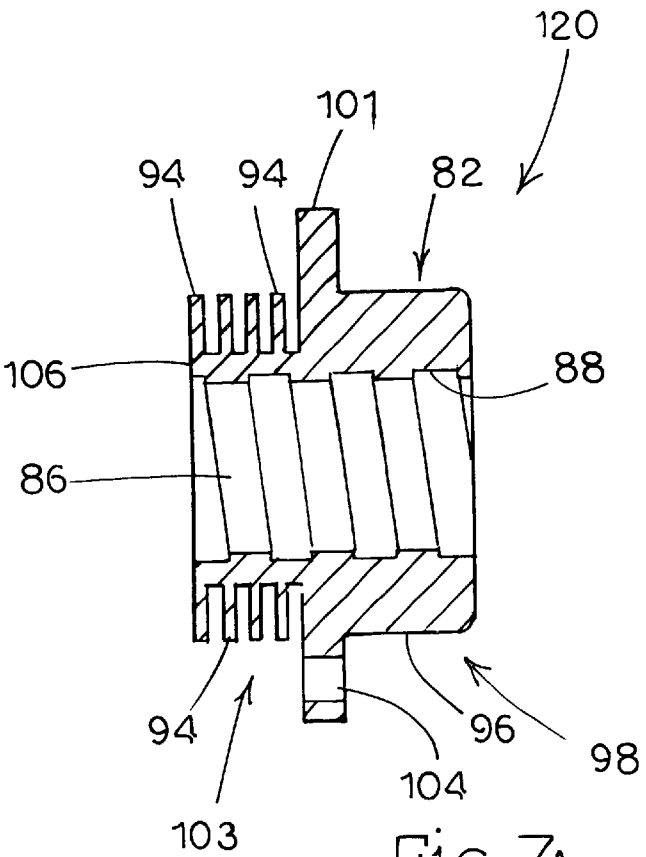
FIG. 7A is a side cross-sectional view of another sealing member according to the present invention.

FIGS. 7A and 7B illustrate another sealing member generally designated 120 according to the present invention. Sealing member 120 can be more effective than, and thus preferred over, sealing member 80 shown in FIGS. 6A and 6B for many high-viscosity/high-temperature polymer processing applications. Similar features shared between sealing member 120 in FIGS. 7A and 7B and sealing member 80 in FIGS. 6A and 6B are designated using the same reference numerals.

With respect to sealing member 120 in FIGS. 7A and 7B, the diameter of second section 103 of sleeve 82 is considerably reduced. This results in a reduced annular thickness 106. In addition, the width of fins 94 is reduced. By comparison to sealing member 80 in FIGS. 6A and 6B, the diameter of second section 103 with fins 94 is reduced from 3.0" to 2.0", such that fins 94 have a radial height of 0.336". Annular thickness 106 of sleeve 82 is reduced from 0.5" to 0.15". The width or thickness of fins 94 is reduced from 0.09" to 0.06". These reduced dimensions result in reduced mass and cross-sectional areas of sealing member 120 and, consequently, improved rate of heat dissipation from the journal area of sealing member 120 during operation of the gear pump. The reduced thickness of fins 94 enables a greater number of fins 94 to be used for the same axial length of sleeve 82, if desired. It should also be noted that the reduced dimensions do not affect the amount of surface area available for heat transfer.

Figure 8:
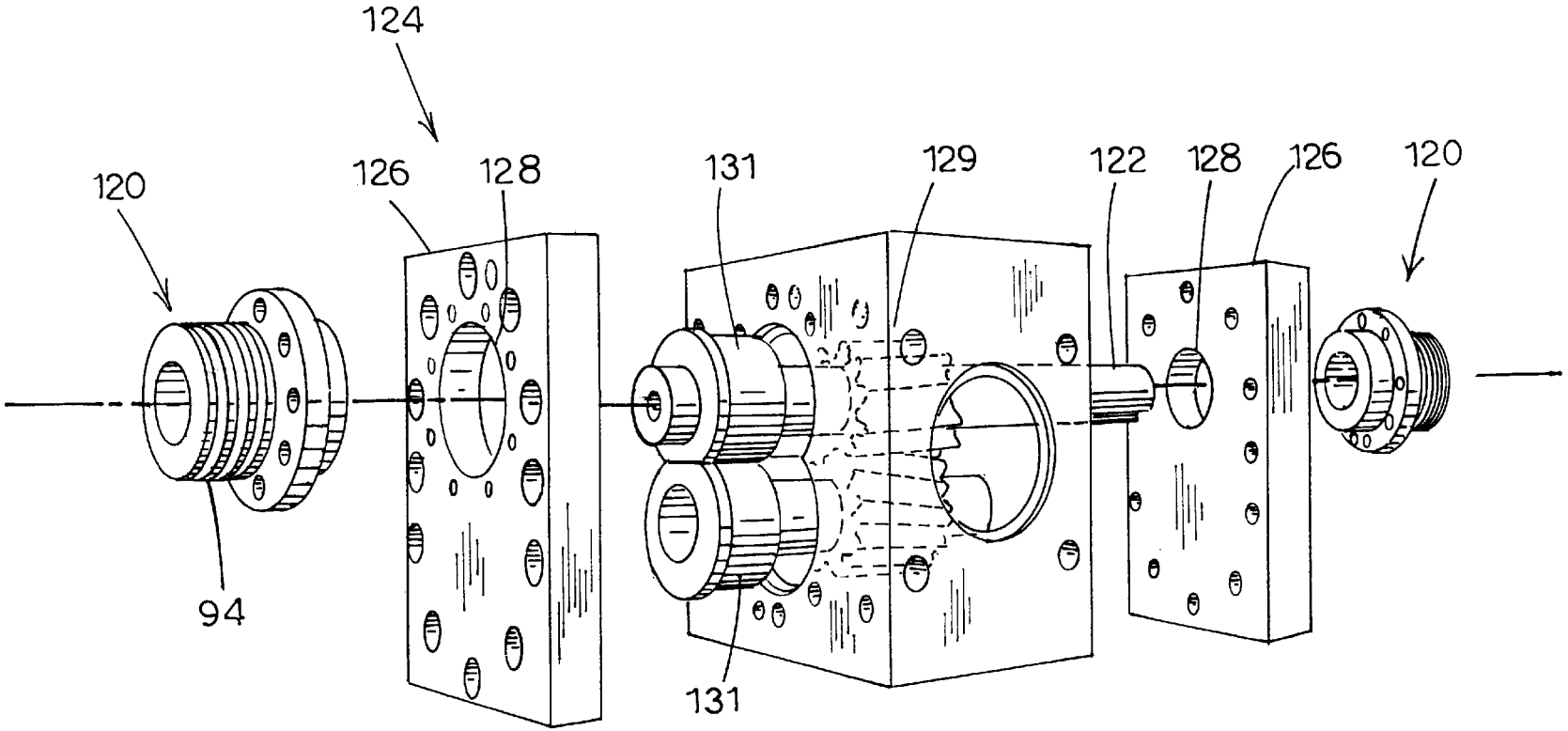
FIG. 8 is an exploded view of a gear pump including sealing members according to one embodiment of the present invention.

In operation, sealing member 120 (or sealing member 80) is fitted onto one or both ends of a drive shaft 122 of a gear pump 124, as shown in FIG. 8. End plates 126 of gear pump 124 include mounting holes 128 to receive sealing members 120. A portion of the pressurized polymeric material flowing within gear pump 124, especially that portion distributed through journal bearings 131 on either side of gears 129, tends to leak in an axially outward direction into clearance spaces in end plates 126 at the sealing members 120. The leaking portion enters helical channels 88 of sealing members 120. Fins 94 on sealing members 120 take full advantage of the temperature gradient between drive shaft 122 and the atmosphere, thereby contributing to a rapid cooling of the polymeric material contained in helical channels 88. At least a portion of the polymeric material in helical channels 88 consequently solidifies to form a frictionless mechanical plug or seal and prevent polymeric material from escaping through sealing members 120.

Figure 9:
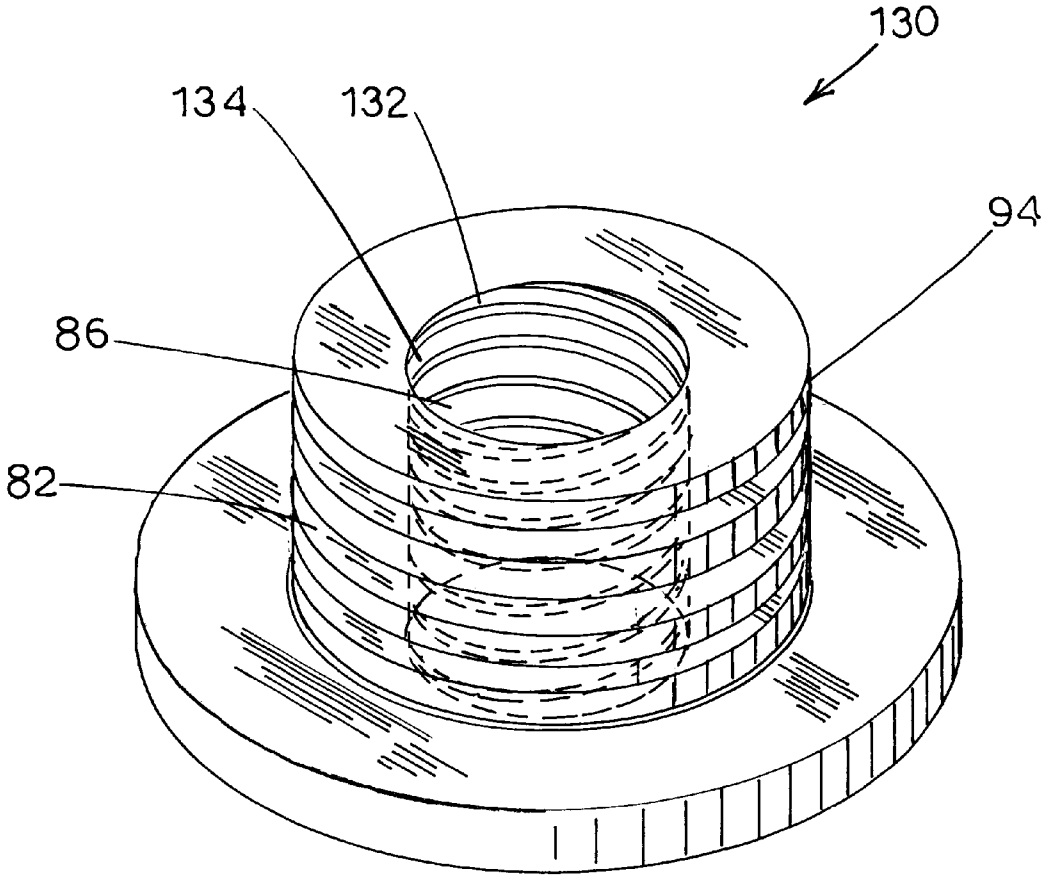
FIG. 9 is a perspective view of a third sealing member according to the present invention.

FIG. 9 illustrates a third embodiment of the invention, sealing member 130, that includes two helical channels 132, 134 within cylindrical bore 86. Helical channels 132, 134 both run along the same axial length of sleeve 82, preferably 180 degrees out of phase with each other on the circumference of the cylindrical bore 86. This configuration may be preferred in order to increase the amount of cooled polymeric material available to form the seal. In other cases, one or more additional channels may be needed in order to enable the cross-sectional areas of the channels to be reduced while retaining a sufficient sealing area for the associated shaft. In still other cases, each helical channel 132, 134 may be sized differently from each other to achieve different dynamic effects in sealing member 130.

Figure 10B:
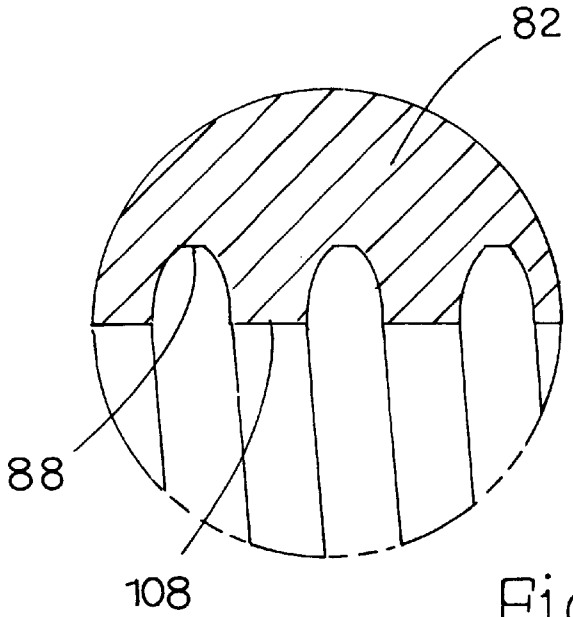
FIG. 10B is an enlarged fragmentary cross-sectional view of another helical groove of a sealing member according to the present invention.
Figure 10A:
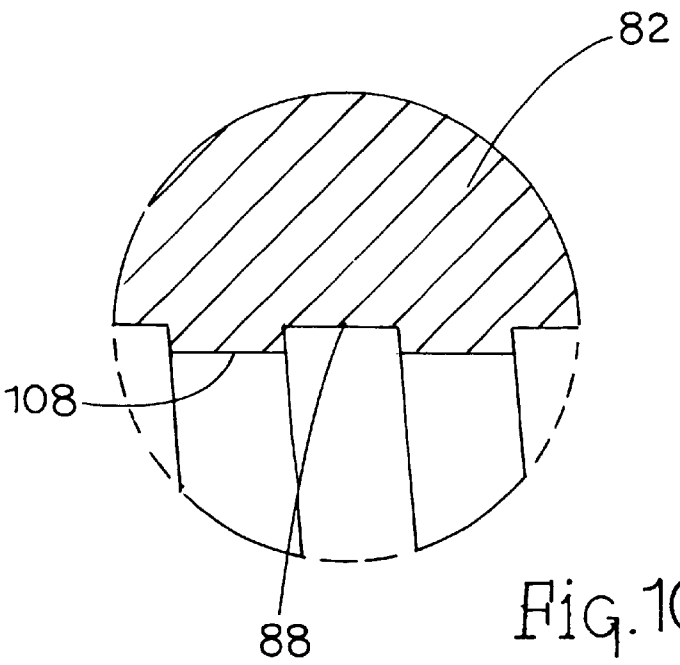
FIG. 10A is an enlarged fragmentary cross-sectional view of a helical groove of a sealing member according to the present invention.

FIGS. 10A and 10B illustrate two of many suitable cross-sectional profiles for helical channel 88. The rectangular profile shown in FIG. 10A has been found to be suitable under the conditions thus far tested, and therefore is preferred. The profile shown in FIG. 10B is analogous to the inverse flight of a screw thread and presents an alternative. The exact profile chosen will depend upon several fluid mechanical properties, such as those used to determine the Reynolds number in a fluid system. In the case where two or more helical channels 88 are used, the profile of each channel 88 may differ to achieve different sealing effects.

It will be understood that other embodiments of the present invention may be manufactured in a variety of ways, and that these other embodiments are contemplated to fall within the scope of the present invention. For instance, the shape, number and configuration of cooling fins 94 may be changed. It will also be understood that other types of channels or grooves may be utilized in cylindrical bore 85 of sleeve 82. In the embodiments shown in the Figures, the twisting or turning path taken by helical channel 88 around a shaft provides a large sealing area for the shaft and the orientation or "hand" of the helix shape in opposition to shaft rotation slows down the leakage rate to afford the polymeric material time to solidify. These effects, however, may be emulated in other types of winding or labyrinthine channels, although the helical path is preferred and relatively easy to form.

It will be further understood that various other details or features of the invention may be changed without departing from the scope of the invention. Furthermore, the foregoing description is for the purpose of illustration only, and not for the purpose of limitation—the invention being defined by the claims. in other types of winding or labyrinthine channels, although the helical path is preferred and relatively easy to form.

It will be further understood that various other details or features of the invention may be changed without departing from the scope of the invention. Furthermore, the foregoing description is for the purpose of illustration only, and not for the purpose of limitation—the invention being defined by the claims.

What is claimed is:

1. An air-cooled shaft comprising:

(a) an annular body having an inner surface and an outer surface, and including a first axial region and a second axial region, wherein the first axial region has a first outside diameter and the second axial region has a second outside diameter less than the first outside diameter;

(b) at least two helical channels formed on the inner surface; and (c) a plurality of external surfaces disposed in axially spaced relationship on the outer surface of the annular body in the second axial region, each external surface extending radially in a direction away from a longitudinal axis of the annular body.

2. The seal according to claim 1 further comprising a flange disposed around the annular body.

3. The seal according to claim 2 wherein the flange is disposed at a location on the annular body defining a boundary between the first and second axial regions.

4. The seal according to claim 2 wherein the flange has a plurality of bores.

5. The seal according to claim 2 wherein each external surface has an outside diameter, the flange has an outside diameter, and the outside diameter of each external surface is equal to the outside diameter of the flange.

6. The seal according to claim 2 wherein:

(a) the flange includes a group of bores circumferentially spaced at a radial distance from the longitudinal axis of the annular body;

(b) each external surface includes a group of bores circumferentially spaced at a radial distance from the longitudinal axis of the annular body; and (c) a center of each one of the group of bores of the flange is coincident with a center of a corresponding one of the group bores of each external surface.

7. The seal according to claim 1 wherein each external surface defines an annular disk.

8. The seal according to claim 1 wherein each external surface has an outside diameter equal to the first outside diameter of the first axial region.

9. The seal according to claim 1 wherein each external surface defines an annular fin.

10. The seal according to claim 1 wherein the first axial region has a first inside diameter and the second axial region has a second inside diameter, and a first radial distance between the first inside and first outside diameters of the first axial region is greater than a second radial distance between the second inside and second outside diameters of the second outside region.

11. The seal according to claim 1 wherein the helical channels define respective flow paths, and one of the flow paths travels along the inner surface 180 degrees out of phase with respect to at least one of the other flow paths.

12. The seal according to claim 1 wherein the annular body is cylindrical.

13. The seal according to claim 1 wherein one of the external surfaces is disposed in coaxial relationship with a length of at least one of the helical channels.

14. The seal according to claim 1 wherein at least one of the helical channels has a rectangular profile.

15. An air-cooled shaft seal for preventing fluid from leaking outside a housing through a hole in the housing, wherein a rotatable shaft is disposed in the housing and mounted in the hole such that an outer portion of the shaft extends outside the housing, the seal comprising:

(a) an annular body having a cylindrical inner surface and inserted onto the shaft, wherein a first section of the annular body is disposed in the hole of the housing between an inner surface of the hole and an outer surface of the shaft, and a second section of the body is disposed outside the housing;

(b) means for removably securing the annular body in fixed relationship to the housing;

(c) means disposed on the second section of the annular body for permitting the transfer of heat energy to the atmosphere from an annular space defined between the cylindrical inner surface of the annular body and the outer surface of the shaft; and (d) means including at least two helical channels formed on the inner surface of the annular body for permitting a volume of fluid contained in the housing to enter the annular space during rotation of the shaft, wherein the means for permitting the transfer of heat energy causes the volume of fluid to at least partially solidify in the annular space.

16. A gear pump for transporting a viscous material under pressure comprising:

(a) a housing having a first side including a first hole;

(b) a shaft disposed in the housing and extending through the first hole, the shaft having a first outer section disposed outside the housing beyond the first hole;

(c) a first sealing member annularly disposed around the shaft and defining an annular space between an inner surface of the first sealing member and the outer surface of the shaft, the first sealing member having a first portion disposed in the first hole and a second portion disposed outside the housing, the first portion having a first outside diameter and the second portion having a second outside diameter less than the first outside diameter;

(d) a plurality of external surfaces disposed in axially spaced relationship on the second portion of the first sealing member; and (e) at least two helical channels formed on the inner surface of the sealing member.

17. The gear pump according to claim 16 wherein the shaft operably communicates with a motor.

18. The gear pump according to claim 16 wherein at least one of the helical channels of the first sealing member has an end communicating with an interior of the housing.

19. The gear pump according to claim 16 wherein at least one of the helical channels extends in a direction away from the housing according to a helical orientation opposite to a turning orientation defined by rotation of the shaft.

20. The gear pump according to claim 16 further comprising a flange disposed on the first sealing member.

21. The gear pump according to claim 20 wherein each external surface has an outside diameter, the flange has an outside diameter, and the outside diameter of each external surface is equal to the outside diameter of the flange.

22. The gear pump according to claim 16 wherein each external surface has an outside diameter equal to the first outside diameter of the first portion.

23. The gear pump according to claim 16 wherein each external surface defines an annular disk.

24. The gear pump according to claim 16 further comprising a second sealing member annularly disposed around the shaft, the second sealing member having a first portion disposed in a second hole of a second side of the housing and a second portion disposed outside the housing, the second sealing member including a plurality of external surfaces disposed in axially spaced relationship on the second portion of the second sealing member.

25. The gear pump according to claim 16 wherein the annular space between the inner surface of the sealing member and the outer surface of the shaft contains a polymeric material.

26. A method for cooling a shaft seal comprising the steps of:

(a) providing a sealing member adapted for insertion onto a rotatable shaft and for sealing the shaft at a location in which the shaft extends through a wall of a housing, wherein the sealing member defines an annular space between an inner surface of the sealing member and an outer surface of the shaft;

(b) forming at least two channels on the inner surface of the sealing member to permit a volume of fluid disposed in the housing to flow into the channels and within the annular space;

(c) reducing a cross-sectional area of a section of the sealing member; and (d) forming a plurality of axially spaced fins disposed on the section of reduced cross-sectional area and that extend radially outwardly therefrom.

* * * * *